United States Patent [19]

Zippel

[11] 4,218,838

[45] Aug. 26, 1980

[54] IDENTIFICATION CARRIER

[75] Inventor: Herbert Zippel, Altdorf, Fed. Rep. of Germany

[73] Assignee: Herbert Zippel GmbH & Co. KG, Nurnberg, Fed. Rep. of Germany

[21] Appl. No.: 884,364

[22] Filed: Mar. 7, 1978

[30] Foreign Application Priority Data

Apr. 19, 1977 [DE] Fed. Rep. of Germany ..... 2717318

[51] Int. Cl.[3] ..... B42F 21/00

[52] U.S. Cl. ..... 40/359

[58] Field of Search ..... 40/360, 359, 23, 23 A; 116/321

[56] References Cited

U.S. PATENT DOCUMENTS

| | | | |
|---|---|---|---|
| 1,826,614 | 10/1931 | Graff et al. | 40/23 A |
| 2,603,219 | 7/1952 | Jones | 40/359 |
| 3,438,143 | 4/1969 | Wolfesberger | 40/23 R |

FOREIGN PATENT DOCUMENTS

| | | | |
|---|---|---|---|
| 2052324 | 10/1970 | Fed. Rep. of Germany | 40/359 |
| 2050756 | 10/1970 | Fed. Rep. of Germany | 40/23 A |
| 1217084 | 12/1970 | United Kingdom | 40/359 |

*Primary Examiner*—Louis G. Mancene
*Assistant Examiner*—Wenceslao J. Contreras
*Attorney, Agent, or Firm*—Darby & Darby

[57] ABSTRACT

A carrier for holding an identification strip and adapted to be mounted on one edge of a register means. A first wall is affixed to a common wall to define a pocket in which the identification strip is received. A second wall is affixed to the common wall to define a second pocket. A plurality of signal means are disposed within the second pocket. Each of the signal means is selectively movable to be brought adjacent to and away from a respective portion of the identification strip. In one embodiment, a signal means retaining member having a plurality of windows is disposed within the second pocket so that the windows receive handle means which protrude from each of the plurality of signal means. The carrier is mounted to an edge of the register means by a pair of clamping legs extending from the common wall.

14 Claims, 3 Drawing Figures

IDENTIFICATION CARRIER

Figure 1:
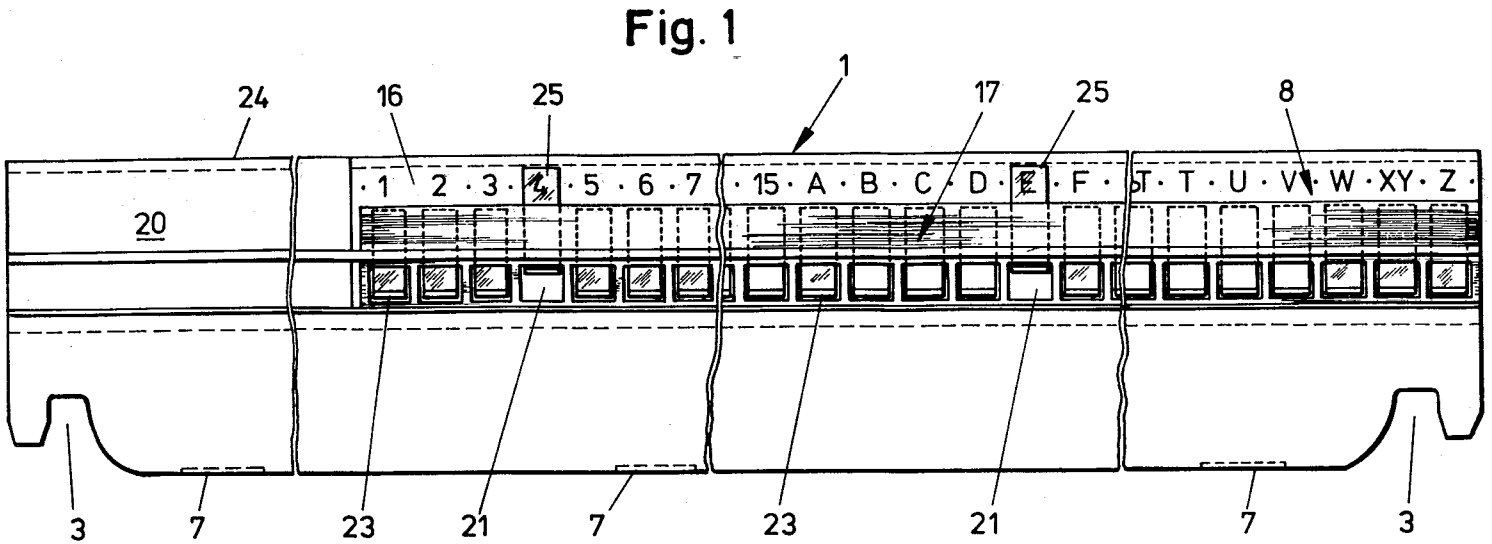

This invention relates to an identification carrier of plastic adapted to be mounted on one edge of a register means with the aid of a mounting element, comprising a clamping pocket which is open at the bottom and which includes a clamping wall narrower than the rear wall for receiving the one longitudinal edge of a signal bar mounted to be longitudinally displaceable, abutting with the free edge of the other longitudinal edge against a stop bar of the rear wall and including signal slides which are guided transversely thereto and consist of an identification strip.

Identification carriers of this type are commonly sold on the market and preferably have a length corresponding to the register edge of a register means. Such identification carriers are frequently designed also as tracks for hanging up the register means, e.g. index cards, files, pockets or the like. In such cases, the organization track of the identification carrier is designed to be longer than the actual register edge of the register means, in particular longer by a distance corresponding to the suspension hooks located at both ends. The mounting element or the base of the identification carrier, on the other hand, has a length corresponding to the register edge. The organization track is bent backwardly at an inclined angle relative to the mounting element or the register edge when seen in the direction in which the registry is viewed.

In the case of this known identification carrier, the mounting element is formed by a bar integrally formed on the organization track and whose free and offset longitudinal edge is fused onto the rear wall of a transparent plastic filing pocket. The front wall of the transparent filing pocket is narrower than the rear wall and is provided with a large recess permitting correspondence and documentation to be easily inserted into or removed from the pocket. The transparent filing pocket can also be replaced by an index card or any arbitrary kind of binder.

The identification strip has a length and width corresponding to the organization track and is held by the clamping wall which has approximately only half the width of the organization track on the rear wall of the clamping pocket with the full size of the organization track between the stop bar and the inner top edge of the clamping wall. The signal bar consists of a transparent strip with a width corresponding to the identification strip, a strip of opaque plastic being attached to the longitudinal edge of said signal bar which is not concealed by the clamping wall. The attachment is effected by means of staples disposed transversely to the longitudinal direction of the opaque strip and which are spaced corresponding to the alphabetic or numerical markings on the identification strip, thereby forming pockets for receiving the signal slides which preferably consist of a transparent colored plastic and which have a length corresponding to the width of the opaque strip. In the longitudinal center of each pocket a slot is provided in each signal slide in the end region facing the stop bar a punctiform recess is provided so that every signal slide can be pushed by means of a sharp object, e.g. the point of a pencil, in the direction of the associated marking of the identification strip as far as the length of said slot will allow. This causes the colored signal tab lying opposite the punctiform recess to move out from beneath the opaque strip and cover the associated marking so that in this way a plurality of different kinds of characteristics can be established and monitored depending on the markings on the identification strip.

The replacement of the identification strip, however, is somewhat time-consuming, since the signal bar must previously be removed and the clamping wall of the clamping pocket must abut with its free longitudinal edge firmly against the rear wall of the clamping pocket by exerting a considerable pressure force. This also makes it more difficult to reinsert the signal bar into the clamping pocket. In so doing, there is a danger that at least the end of the identification strip facing the point of insertion will be damaged by the leading end of the signal bar. Moreover, the signal slides rub directly on the markings of the identification strip. The application of staples and the opaque strip onto the signal bar in particular requires additional work and additional expenditure of material. Furthermore, a sharp object, at least a pointed pencil, must always be at hand in order to set the signal slides.

The object of the invention thus consists of developing and improving the known identification carrier, preferably of clear transparent plastic, for attachment to an edge of a register means with the aid of a mounting element as well as the other features mentioned in the first paragraph at the outset in such a way that the identification strip and the signal bar are easy to replace and the signal slides can be set or slid manually without auxiliary devices.

This object is accomplished in accordance with the invention in that an insertion pocket open at the top is provided for the identification strip on the rear side of the clamping pocket integrally formed with the mounting element, and that the signal bar which extends with a longitudinal edge beneath the clamping wall and which consists of opaque plastic has closely spaced proximate windows with a width corresponding to the signal slides on the other longitudinal edge, each signal slide being respectively provided on the transverse edge visible in said window with a manipulator which guides the associated signal slide in said window.

These measures create an identification carrier in which the identification strip is provided in a separate insertion pocket and consequently can be interchanged as desired irrespectively of the signal bar. Every signal slide can be displaced by hand without auxiliary devices, and in so doing merely glides on the rear wall of the clamping pocket and not on the markings on the identification strip any longer. The signal bar is an integral section which is thus economical to manufacture and which consists predominantly of colored, but usually of opaque plastic. It is therefore easy to manipulate and can be removed easily if the necessity should arise, for instance, when instead of signal slides sliding file signals, for instance, are to be used which have a profile shape corresponding to the signal bar as well as a width and, if desired, thickness which is a multiple of the signal slides.

Figure 3:
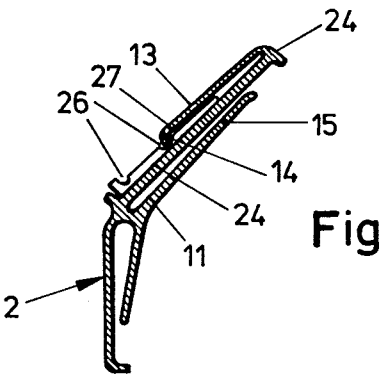
Figure 2:
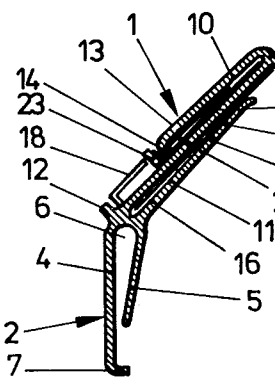

The invention will now be explained in more detail with reference to an embodiment which reveals other advantageous features of the invention. In the drawing, FIG. 1 is an elevation of an identification carrier for a registry means which is designed as a suspension track, FIG. 2 is a front end elevation of the identification carrier according to FIG. 1 and FIG. 3 is a front end elevation according to FIG. 2 of an identification carrier featuring a sliding file signal.

The identification carrier 1 illustrated as the embodiment is adapted to be attached to the suspension edge of a register means designed, for example, as a suspended card, pocket, binder or the like. For this purpose, the lower longitudinal edge of the identification carrier forming the mounting element 2 for the register means is provided adjacent the front ends with a open-edged notch 3 for engagement with support tracks (not shown) on which the identification carriers 1 are mounted such that they can be moved transversely to their longitudinal direction. The identification carrier of course can also be used for standing and/or flat registers, its length then merely corresponding to the length of the respective register edge of a register means.

The mounting element 2 for connection with the register edge of a register means is formed in the instant case by two bar-like clamping legs 4 and 5 which are integrally interconnected at the top edge by the groove 6 and which have unequal lengths when seen in cross section. Several claw-like projections 7 extending along the free longitudinal edge toward the shorter clamping leg 5 are formed on the cross-sectionally longer clamping leg 4. These projections are associated with corresponding slot-like cut-outs or recesses in the register edge of the respective register means. After the identification carrier has been secured to a register edge, its free longitudinal edge is situated in the groove 6 between the two clamping legs 4, 5, the claw-like projections 7 of the longer clamping leg 4 engage the cut-outs and recesses of the register edge and the shorter clamping leg 5 pushes the register edge of the associated register means against the longer clamping leg 4.

When seen in the direction in which the registry is viewed, an organization track 8 which is bent backward at an inclined angle is formed externally on the groove 6 of the mounting element 2 connecting clamping legs 4 and 5. It is formed by a strip-like wall which at the front simultaneously forms the rear wall 9 for a clamping pocket 10 which is open at the bottom and at the back forms the rear wall of an insertion pocket 11 which is open at the top. On the front side adjacent to the point of connection to the groove 6, the width of the rear wall 9 common to the clamping pocket 10 and the insertion pocket 11 is restricted by an internal stop bar 12.

At the top edge of the rear wall 9 there is disposed, a clamping wall 13 of the clamping pocket 10. clamping wall 13 extends across a portion of the front side and projects somewhat beyond the rear wall in order to make it easier to grip the identification carrier. The clamping wall 13 has on its free longitudinal edge an inwardly directed projecting clamping edge 14 whose importance is explained hereinbelow.

Furthermore, the front wall 15 necessary for the insertion pocket 11 is also formed on the groove 6 in the area of said groove which interconnects the clamping legs 5 and 4 so that said front wall 15 can exert a slight pressure on the rear wall 9. Such an identification carrier is manufactured from a clear plastic preferably by continuous extrusion or transfer molding methods. The insertion pocket 11 serves to receive an identification strip 16 which has a width corresponding to the clear width of the insertion pocket. The top edge of the identification strip 16 is provided with characteristics or numerical or alphabetical markings over its length corresponding to a signal bar 17 which will be explained hereinafter. Permanent ordering information such as order numbers, job batches, numbers of pieces and the like can be given on a section of the identification strip which is not covered up by the signal bar 17 for instance. In order to be able to insert the identification strips into the insertion pocket 11 easily, the free longitudinal edge of the front wall 15 can be bent outwardly somewhat.

The signal bar 17 is shaped as a profile strip with one longitudinal edge portion 18 thereof being guided between the stop bar 12 and the clamping edge 14 of the clamping wall 13. This longitudinal edge portion 18 can have a reversed flat U-shaped cross section, whereas the other longitudinal edge portion 19 of the clamping bar 17, which may be somewhat larger in width if desired, is substantially flat and extends into the clamping pocket.

Longitudinal edge portion 19 may be formed with a groove for engagement of clamping edge 14 of clamping wall 13, said groove forming a projecting edge on the lower surface of signal bar 17. The signal bar 17 can have a length corresponding to the identification carrier 1 or to the identification strip 16. Preferably, however, signal bar 17 is somewhat shorter in length so that a field 20 which can be used for lettering remains uncovered on the identification strip 16. The signal bar consists mainly of a colored opaque plastics material.

Closely adjacent windows 21 whose openings are about identical in width to the width of the signal slides 22 are provided in the longitudinal edge 18 of the signal bar 17 extending between the stop bar 12 of the rear wall 9 and the clamping edge 14 of the clamping wall 13. In every window 21 a strip-like signal slide 22 is provided whose length corresponds approximately to the entire width of the signal bar. A manipulator 23 projecting somewhat from the window and by means of which the respective signal slide is simultaneously conducted as it is moved is formed on the transverse edge of each signal strip which is visible in a window 21. If the one or the other signal slide 22 is displaced toward the top edge 24 of the identification carrier, its signal tab moves out from under the concealing, broader longitudinal edge 19 of the signal bar 17 on the one hand and, on the other hand, itself conceals the associated marking on the identification strip 16. Since the colored signal slides 22, however, are manufactured of a transparent plastic, the marking concealed by a signal tab 25 nevertheless remains visible through the signal tab.

Every signal slide 22 has a transverse groove 26 equidistant from its two end positions in which the bridge-like elevations on the lower side of the signal bar 17 can be locked into position due to the action of the clamping edge 14 of the clamping wall 13 so that a definite end position of the signal slide 22 is ensured in this way. In the event that only sliding file signals 27 are used in place of a signal bar 17 with signal slides 22 (see FIG. 3), these have the same construction in principle as the signal slides 22 except that they are considerably thicker in the longitudinal direction of the identification carrier 1 and have a substantially thicker design in an upward perpendicular direction.

What is claimed is:

1. A carrier adapted to be mounted to a register means for holding an identification strip, said carrier comprising:

a common wall;

means for mounting said common wall to an edge of said register means;

a first wall affixed to said common wall to define a first pocket between said first and common walls;

an identification strip located within said first pocket;

a second wall affixed to said common wall to define a second pocket between said second and common walls; and a plurality of signal means each of which is at least partially disposed within said second pocket, each of said signal means being selectively movable to be brought adjacent to and away from a respective portion of said identification strip.

2. A carrier according to claim 1 wherein one of said pockets opens in one direction and the other pocket opens in the opposite direction.

3. A carrier according to claim 1 wherein said second wall is affixed in the vicinity of one edge to said common wall, the free edge of said second wall opposite to said affixed edge being directed inwardly toward said common wall.

4. A carrier according to claim 1 further comprising stop means protruding from said common wall for limiting the possible displacement of each of said plurality of movable signal means.

5. A carrier according to claim 3 wherein each of the plurality of signal means includes a pair of transverse grooves each of which is capable of engagement with said inwardly directly free edge of said second wall to define a pair of stop positions for each of said signal means.

6. A carrier according to claim 4 wherein said stop means comprises a ridge protruding from said common wall and arranged offset from the opening of said second pocket.

7. A carrier according to claim 1 wherein each of said second and common walls are transparent to that said identification strip can be seen through said common and second walls.

8. A carrier according to claim 1 wherein each of said plurality of signal means is light opaque.

9. A carrier according to claim 1 further comprising handle means projecting from each of said signal means for moving each said signal means, and a signal means retaining member having a plurality of windows each being capable of receiving one of said movable handle means, said retaining member at least partially disposed within said second pocket.

10. A carrier according to claim 9 wherein said plurality of windows are arranged adjacent to a longitudinal edge of said retaining member, the portion of said retaining member adjacent the opposite longitudinal edge of said retaning member being disposed within said second pocket.

11. A carrier acording to claim 9 wherein a longitudinally extending groove is formed in said retaining member, said second wall affixed in the vicinity of one edge to said common wall, the free edge of said second wall opposite to said affixed edge being directed toward said common wall, said free edge engaging said groove.

12. A carrier according to claim 1 wherein said plurality of signal means are arranged in a row, each of said signal means movable in a direction running transverse to the longitudinal axis of the row.

13. A carrier according to claim 1 wherein said mounting means comprises a pair of clamping legs, one edge of said register means received between said pair of legs.

14. A carrier according to claim 13 wherein said pair of clamping legs are of unequal length, the longer of said legs including a plurality of claws extending toward the remaining leg, said plurality of claws engaging corresponding openings defined in said register means.

* * * * *